US011687033B2

(12) United States Patent
Villar et al.

(10) Patent No.: US 11,687,033 B2
(45) Date of Patent: Jun. 27, 2023

(54) SELF-WINDING WATCH

(71) Applicant: ETA SA Manufacture Horlogere Suisse, Grenchen (CH)

(72) Inventors: Ivan Villar, Bruegg (CH); Laurent Kaelin, Sonvilier (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 495 days.

(21) Appl. No.: 16/925,516

(22) Filed: Jul. 10, 2020

(65) Prior Publication Data

US 2021/0048780 A1 Feb. 18, 2021

(30) Foreign Application Priority Data

Aug. 15, 2019 (EP) ..... 19191994

(51) Int. Cl.
*G04B 5/04* (2006.01)
*G04B 5/16* (2006.01)
(Continued)

(52) U.S. Cl.
CPC ..... *G04B 5/04* (2013.01); *G04B 5/16* (2013.01); *G04B 5/165* (2013.01); *G04B 47/044* (2013.01);
(Continued)

(58) Field of Classification Search
CPC . G04B 5/04; G04B 5/16; G04B 45/02; G04B 5/165; G04B 47/044; G04B 45/003; G04B 45/0046; G04B 45/0038
See application file for complete search history.

(56) References Cited

U.S. PATENT DOCUMENTS 8,687,468 B2 * 4/2014 Nagatake ..... G04B 45/0061 368/233
8,801,269 B2 * 8/2014 Grossenbacher .... G04B 19/225 368/208
(Continued)

FOREIGN PATENT DOCUMENTS

CH 707 940 A1 10/2014
EP 3 428 737 A1 1/2019
(Continued)

OTHER PUBLICATIONS

Machine translation of JP-2016099267-A (Year: 2023).*
(Continued)

*Primary Examiner* — Sean Kayes
*Assistant Examiner* — Sean R Brannon
(74) *Attorney, Agent, or Firm* — Oblon, McClelland, Maier & Neustadt, L.L.P.

(57) ABSTRACT

A self-winding mechanical horological movement including a pivotally oscillating weight, wherein the oscillating weight is provided with a decorative disc mounted on the oscillating weight and pivotally driven by the weight. The disc is fastened to a support that includes a stem inserted into a hole provided in the rotational shaft of the weight. The stem and the hole include non-circular section cylindrical portions corresponding with one another, so that the support and the disc are pivotally driven by the shaft. The disc forms a decoration that covers the entire surface of the movement, without requiring technical complexities. The disc can be free to undergo an axial movement in relation to the weight, so that the disc may be removed from the weight when the horological movement is dismantled from a watch case.

8 Claims, 2 Drawing Sheets

(51) Int. Cl.

| | |
|---|---|
| ***G04B 47/04*** | (2006.01) |
| *G04B 45/02* | (2006.01) |
| *G04B 45/00* | (2006.01) |

(52) U.S. Cl.

CPC ..... *G04B 45/003* (2013.01); *G04B 45/0038* (2013.01); *G04B 45/0046* (2013.01); *G04B 45/02* (2013.01)

(56) References Cited

U.S. PATENT DOCUMENTS

| | | | | |
|---|---|---|---|---|
| 2006/0239124 | A1* | 10/2006 | Thumm ..... | G04B 45/02 368/88 |
| 2012/0155229 | A1 | 6/2012 | Araki et al. | |
| 2019/0018367 | A1 | 1/2019 | Rachdi et al. | |
| 2019/0332063 | A1* | 10/2019 | Leskerpit ..... | G04B 45/0038 |

FOREIGN PATENT DOCUMENTS

| | | | | |
|---|---|---|---|---|
| JP | 11-23737 | A | | 1/1999 |
| JP | 2000-7984 | | | 12/2000 |
| JP | 2016-99267 | A | | 5/2016 |
| JP | 2016099267 | A | * | 5/2016 |

OTHER PUBLICATIONS

European Search Report dated Feb. 14, 2020 in Eurpoean Application No. 19191994.3 filed Aug. 15, 2019 (with English Translation of Categories of cited documents), 3 pages.

Japanese Office Action dated Jul. 6, 2021 in Japanese Patent Application No. 2020-124981 (with English translation), 7 pages.

Combined Chinese Office Action and Search Report dated Jun. 28, 2021 in Chinese Patent Application No. 202010812136.8 (with English translation), 9 pages.

* cited by examiner

SELF-WINDING WATCH

CROSS-REFERENCE TO RELATED APPLICATION

This application claims priority to European Patent Application No. 19191994.3 filed on Aug. 15, 2019, the entire disclosure of which is hereby incorporated herein by reference.

TECHNICAL FIELD

The present invention relates to a self-winding horological movement as well as a timepiece, such as a wristwatch, equipped with such a movement.

PRIOR ART

Self-winding mechanical watches are well known. The movement of such a watch includes an oscillating weight that drives a winding geartrain connected to the barrel of the watch so as to coil the spring of the barrel during the wearing of the watch. The oscillating weight is pivotally mounted, so that the movements of the wearer generate angular oscillations of the weight. The winding geartrain is generally provided with an inversion system that ensures that regardless of the direction of rotation of the weight, the movement thereof is transformed into a rotation in a single direction, capable of winding the spring.

Conventionally, watches of said type are provided with a transparent case back that makes it possible to see the oscillating weight that is normally located at the back of the movement. It is for this reason that oscillating weights provided with a decoration have been developed, as illustrated for example by documents CH-A-707999 and EP-A-2737372. Said decorations are fairly complex and expensive to produce. Often they only cover a portion of the movement. As a general rule, the decorations are not or not easily separable from the weight itself so that this makes the production not very flexible in the event of requests of varied decorations.

SUMMARY OF THE INVENTION

The aim of the present invention is to produce a self-winding watch including an oscillating weight, which is provided with a decoration, without suffering the disadvantages described in the previous paragraph.

This aim is achieved by the horological movement and by the timepiece according to the appended claims.

To this end, the invention relates to a self-winding mechanical horological movement including an oscillating weight rotably mounted on a portion of the horological movement, characterised in that a decorative disc is attached on the oscillating weight, said decorative disc being rotationally driven by said oscillating weight.

According to preferred embodiments, the disc is fastened to a support that includes a stem inserted into a bore provided in the rotary shaft of the weight. The stem and the bore each comprise a non-circular section portion corresponding with one another, so that the support and the disc are pivotally driven by the shaft.

The disc forms a decoration that covers the entire surface of the movement, without requiring complex technical means. Thus, the decorative disc that covers the oscillating weight over 360° creates a moveable animation that can be seen by the wearer of the watch from the back of a case including a transparent back.

According to preferred embodiments, the disc is free to move according to an axial movement in relation to the weight, so that particularly the disc may be easily removed from the weight when the horological movement is outside of the watch case.

Such a configuration not only makes it possible to be able to easily change decorative discs depending on the request but also to avoid putting strain excessively on the oscillating weight in the event of impacts. Moreover, the principle of easily removing the disc and the support thereof from the shaft of the oscillating weight facilitates the accessibility to the movement, particularly on the casing flanges and screws.

Other features and advantages of the present invention will become apparent in the following description of preferred embodiments, presented by way of non-limiting example with reference to the appended drawings.

DETAILED DESCRIPTION OF EMBODIMENTS OF THE INVENTION

Figure 1:
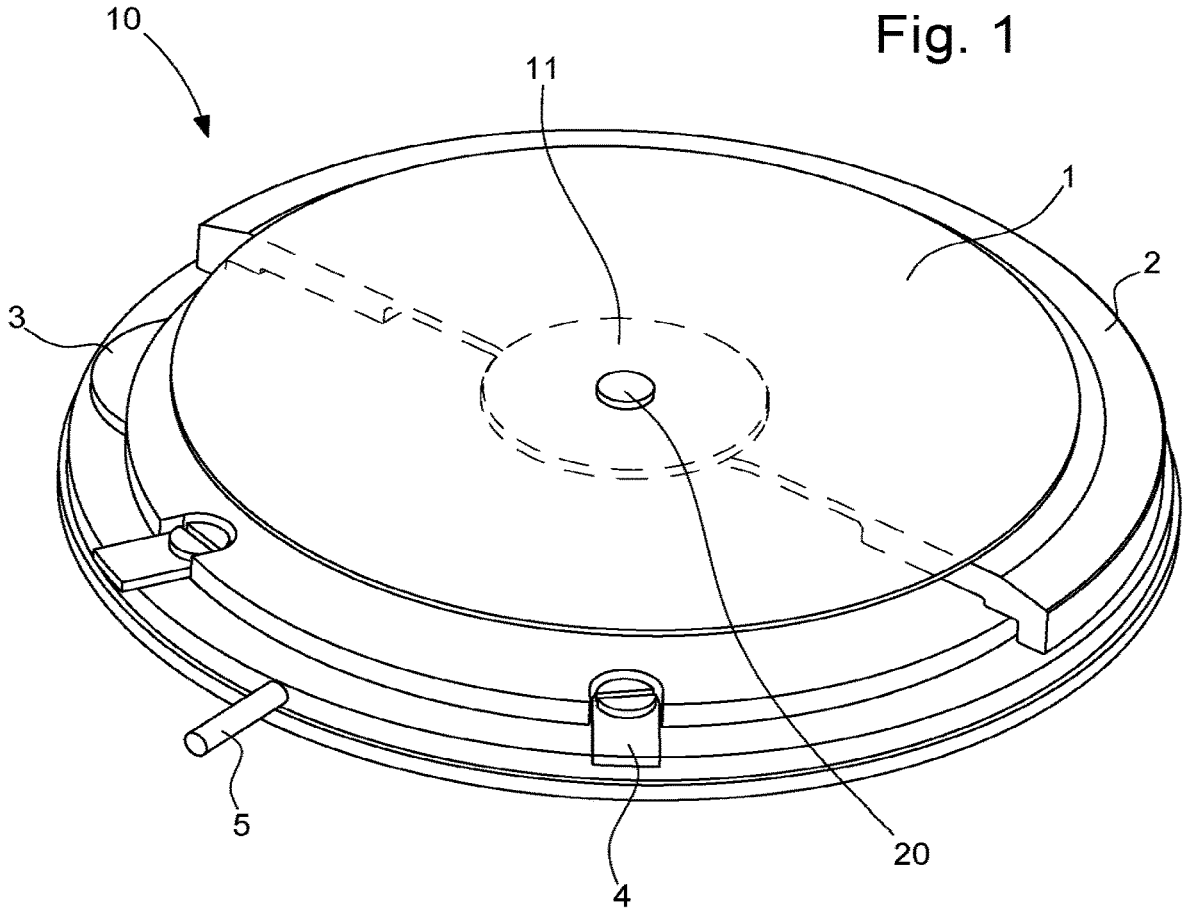
FIG. 1 shows a 3D view of a horological movement according to one embodiment of the invention.

A horological movement 10 according to one embodiment of the invention is shown in FIG. 1. The decorative disc 1 is shown transparently, so as to display the oscillating weight 2 below the disc. Materials that can be used for the disc 1 are for example brass, aluminium, sapphire, ceramic or even any plastic material sufficiently rigid to maintain the shape thereof. The upper surface of the disc 1 visible to the wearer of the watch may be provided with an illustration such as a drawing or engraving (not shown).

In FIG. 1, it is also seen a number of components of the movement, such as gear wheels 3 and flanges 4 fastened by screwing, and the winding-mechanism stem 5. It is clearly understood that the invention is not limited to said type of specific movement.

Figure 2:
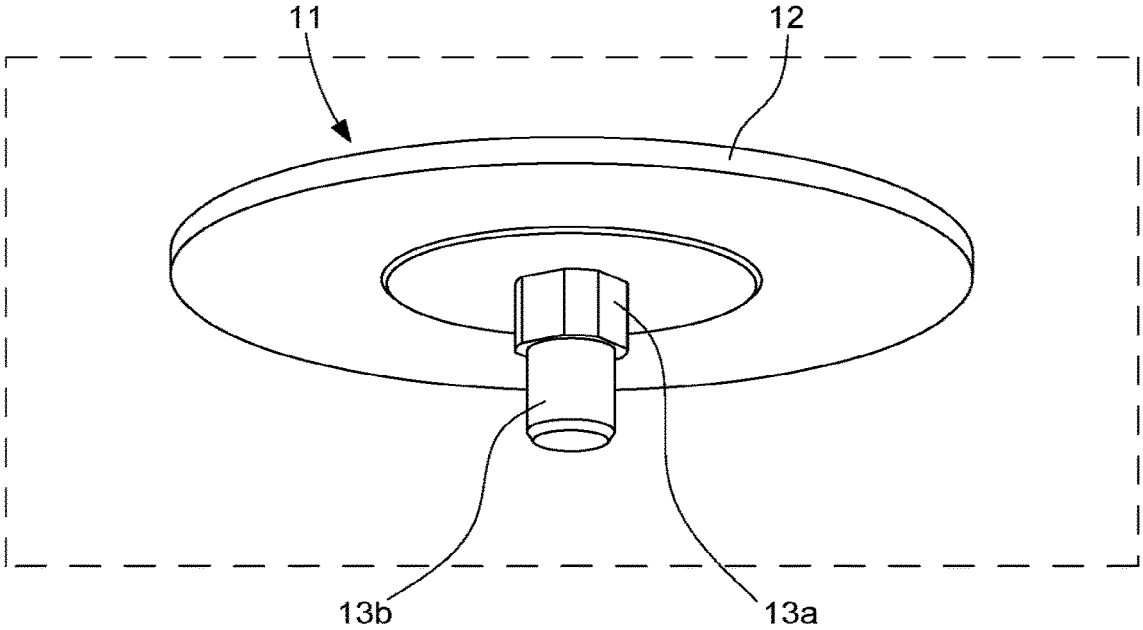
FIG. 2 shows the support of the decorative disc according to one embodiment of the invention.
Figure 3:
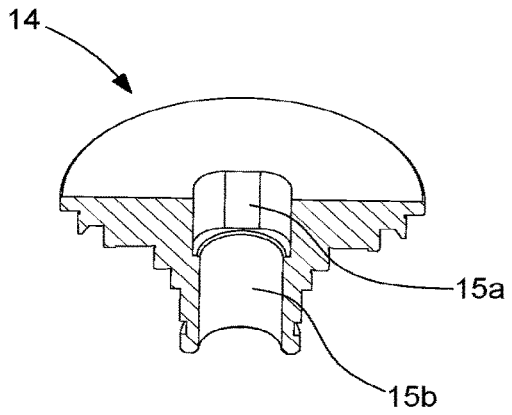
FIG. 3 shows the shaft of the oscillating weight according to one embodiment of the invention.

The decorative disc 1 is fastened for example by gluing to a support 11 that is rotationally driven by the oscillating weight 2. The support 11 could be produced in brass. As illustrated in FIG. 2, the support 11 comprises a circular flat portion 12 and a central stem 13, essentially oriented perpendicular to said circular portion 12. The disc 1 is glued on the upper surface of the circular portion 12, coaxially in relation to the circular portion 12 and of the stem 13. The stem 13 comprises a first square section portion 13*a* whereof the corners are rounded, and a second circular section cylindrical portion 13*b* that follows the first portion 13*a* when the support 11 is oriented with the circular portion 12 upwardly, as illustrated in FIG. 2. Seen in a longitudinal direction of the stem 13, the circular section of the portion 13*b* is located entirely entered inside the outer contour of the square section of the portion 13*a*. The support 11 is inserted by the stem 13 thereof into the shaft 14 of the oscillating weight 2, said shaft 14 being shown in sectional view in FIG. 3.

In the embodiment shown, the weight 2 is fixedly mounted on the shaft 14, for example by riveting, screwing or any other suitable means. According to another embodiment, the weight 2 is integral with the shaft 14, i.e. the weight 2 and the shaft 14 form a uniform piece.

Figure 4:
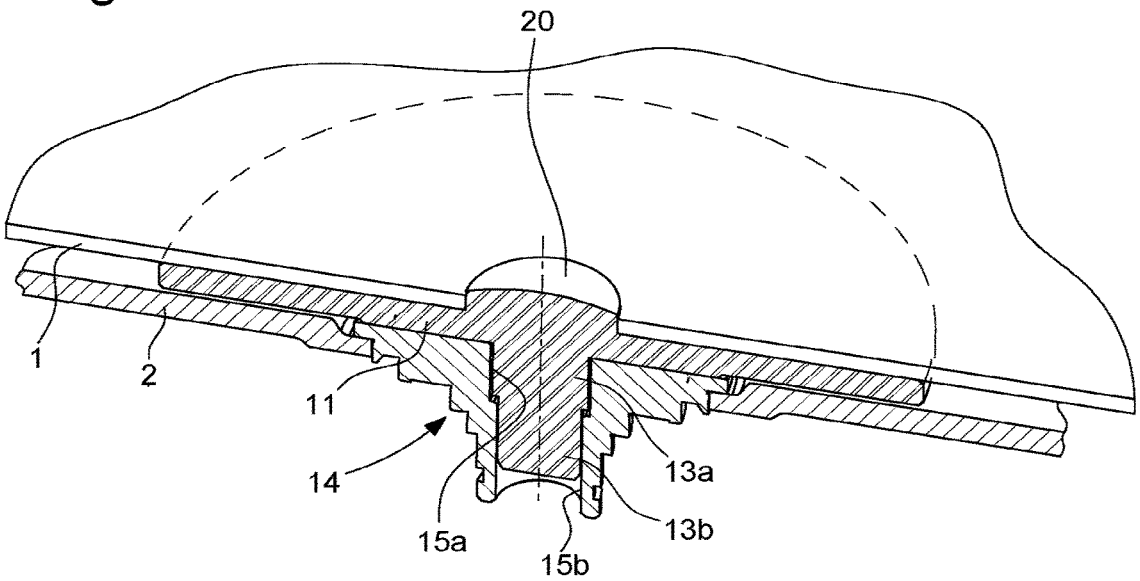
FIG. 4 shows a sectional view of the assembly of the decorative disc and the support thereof, and of the oscillating weight, according to one embodiment of the invention.

The shaft 14 is provided with a central bore 15 including two portions that correspond to the respective portions of the stem 13: a portion having the shape of a square section recess 15*a* followed by a circular section cylindrical portion 15*b*. The corresponding portions of the stem 13 and of the bore 15 are inserted into one another, as illustrated in FIG. 4.

Figure 5:
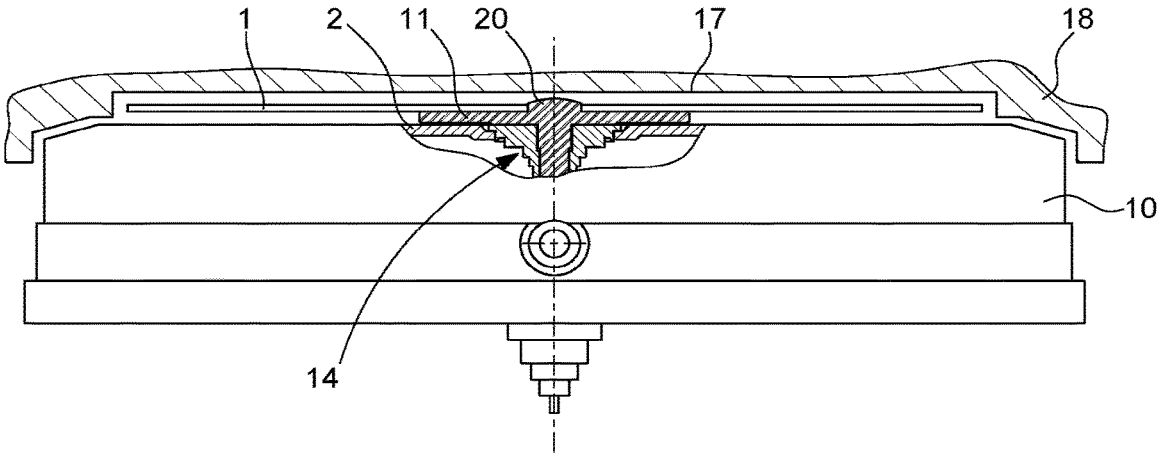
FIG. 5 shows a view of the position of the decorative disc in relation to the back of a watch case, according to one embodiment of the invention.

According to a preferred embodiment, the stem 13 is not tightly fit in the bore 15 but is free to undergo an axial movement in relation to the shaft 14. When the horological movement according to the invention is mounted in a watch case, the freedom of axial movement of the support 11 is limited by the transparent back 17 of the watch case 18, as illustrated in FIG. 5. The freedom of movement in axial direction makes it possible to easily remove the disc 1 from the weight 2 when the movement is outside of the case 18 or when the side of the movement supporting the oscillating weight is accessible whereas it is in the case 18 for example when the back is removed.

The square section portions 13*a* and 15*a* provide the rotational driving of the disc 1 by the oscillating weight 2. It goes without saying that other section shapes may be used instead of the square shape of the section of the portions 13*a* and 15*a*. Any non-circular section shape and that makes it possible to rotationally drive the disc 1 is possible.

The circular section portions 13*b* and 15*b* are not always essential. According to other embodiments, the stem 13 and the hole 15 entirely consist of non-circular section cylindrical portions. Nevertheless, if the technology used for manufacturing the non-circular section portions does not make it possible to achieve a high precision, the decorative disc 1 risks tilting in relation to the hole 15 and the edge of the disc 1 could come into contact with the weight 2. This is why it is advantageous to provide the circular section portions 13*b* and 15*b* that same may be produced with a higher precision due to the less complex shape thereof. In this way, the circular section portions 13*b* and 15*b*, manufactured with the high precision, will provide the guidance of the disc 1 in axial direction, in order to prevent the peripheral edge of the decorative disc 1 entering into contact with the weight 2.

In FIGS. 1 and 4, it is seen that the support 11 is provided with a central portion in the form of a cylindrical pin 20 that protrudes from the upper surface of the support 11, and that is arranged in a central opening of the decorative disc 1, facilitating the coaxial assembly of the disc 1 and the support 11. The distal end of the pin 20 comprises a rounded upper surface and the pin 20 protrudes from the upper surface of the disc 1. Consequently, and as illustrated in FIG. 5, the contact between the back 17 of the watch case 18 and the assembly of the support 11 and of the disc 1 is limited to said rounded surface 20, thus minimising the friction between said assembly and the back 17 of the case 18 and thereby reducing the losses of energy during the winding of the movement by the oscillating weight.

The scope of the invention is not limited to the combination of features of the embodiment shown in the figures. The freedom of axial movement of the disc 1 is preferable but the invention also covers embodiments according to which the disc is maintained in the axial direction by an adequate fastening means, for example a locking system that blocks the stem 13 in the hole 15. The connection between the disc 1 and the oscillating weight 2, making possible or not the axial movement of the disc, could be produced by other technical means equivalent to the support 11, the stem 13 and the hole 15.

The invention claimed is:

1. A self-winding mechanical horological movement comprising an oscillating weight rotably mounted on a portion of the horological movement, wherein a decorative disc is attached on the oscillating weight, said decorative disc being rotationally driven by said oscillating weight wherein the disc is free to move axially in relation to the weight in the direction perpendicular to the disc, so that the disc may be removed from the weight, wherein:

the movement comprises a pivoting shaft, the weight being fastened to or integral with the shaft, the disc is fastened to a support comprising a planar portion to which the disc is attached as well as a stem essentially perpendicular to the planar portion, the stem comprising at least one non-circular section portion, the shaft is provided with a central bore, also comprising at least one non-circular section portion, corresponding to the non-circular section of the portion of the stem, the non-circular section portion of the stem is inserted into the corresponding non-circular portion of the bore, so that the support and the disc are pivotally driven by the shaft.

2. The horological movement according to claim 1, wherein:

the bore comprises a first non-circular section portion followed by a second circular section cylindrical portion, the circular section being entered inside the non-circular section, the stem comprises a first non-circular section portion and a second circular section cylindrical portion, the portions of the stem corresponding to the respective portions of the bore, the introduction of the stem into the bore is carried out by the insertion of the first and second respective portions one inside the others.

3. The horological movement according to claim 1, wherein the non-circular sections are square sections with rounded corners.

4. The horological movement according to claim 1, wherein:

the support is provided with a central pin inserted into a central opening of the decorative disc, the central pin of the support protrudes beyond the upper surface of the decorative disc, the distal end of the central pin comprises a rounded surface.

5. The horological movement according to claim 1, wherein the stem is axially free in relation to the bore so that the decorative disc and the support may be removed from the weight.

6. A timepiece comprising a case and a self-winding mechanical horological movement comprising an oscillating weight rotably mounted on a portion of the horological movement, wherein a decorative disc is attached on the oscillating weight, said decorative disc being rotationally driven by said oscillating weight wherein the disc is free to move axially in relation to the weight in the direction perpendicular to the disc, so that the disc may be removed from the weight and wherein the back of the case is transparent so as to display the decorative disc, wherein:

the movement comprises a pivoting shaft, the weight being fastened to or integral with the shaft, the disc is fastened to a support comprising a planar portion to which the disc is attached as well as a stem essentially perpendicular to the planar portion, the stem comprising at least one non-circular section portion, the shaft is provided with a central bore, also comprising at least one non-circular section portion, corresponding to the non-circular section of the portion of the stem, the non-circular section portion of the stem is inserted into the corresponding non-circular portion of the bore, so that the support and the disc are pivotally driven by the shaft.

7. The timepiece according to claim 6, wherein the decorative disc is free to move in relation to the weight in the direction perpendicular to the disc, the movement of the disc being limited by the back of the case.

8. The timepiece according to claim 6, the piece being a wristwatch.

* * * * *